United States Patent [19]

Dyer

[11] Patent Number: 5,005,507

[45] Date of Patent: Apr. 9, 1991

[54] HYDROFOIL WITH RETRACTABLE PLATE

[76] Inventor: William B. Dyer, 3358 Taylor Rd., Central Point, Oreg. 97502

[21] Appl. No.: 412,151

[22] Filed: Sep. 25, 1989

[51] Int. Cl.[5] ..... B63B 1/24

[52] U.S. Cl. ..... 114/280; 114/145 A; 440/51

[58] Field of Search ..... 114/145 A, 274, 280, 114/145 R, 284; 440/51, 66; 244/113

[56] References Cited

U.S. PATENT DOCUMENTS

| | | | |
|---|---|---|---|
| 1,576,237 | 3/1926 | Dawson | 114/145 A |
| 2,050,336 | 8/1936 | Karasinski | 115/17 |
| 2,256,898 | 9/1941 | Ehmke | 115/0.5 |
| 2,654,336 | 10/1953 | Katzung et al. | 115/0.5 |
| 2,719,503 | 10/1955 | Smith | 115/18 |
| 3,114,343 | 12/1963 | Headrick et al. | 114/66.5 |
| 3,209,716 | 10/1965 | Hartley | 114/145 |
| 3,211,119 | 10/1965 | Kiekhaefer | 114/66.5 |
| 3,965,838 | 6/1976 | Uht | 114/145 A |
| 4,048,940 | 9/1977 | Smith | 114/145 A |
| 4,487,152 | 12/1984 | Larson | 114/145 A |

FOREIGN PATENT DOCUMENTS

| | | | |
|---|---|---|---|
| 423709 | 2/1935 | United Kingdom | 244/113 |

*Primary Examiner*—Sherman Basinger

*Attorney, Agent, or Firm*—James D. Givnan, Jr.

[57] ABSTRACT

A hydrofoil adapted for attachment to a boat propulsion unit. The hydrofoil defines a recessed area on its underside in which a trolling plate may be positioned. A pivot shaft couples the plate to the hydrofoil permitting upright deployment of the plate for slowing of the watercraft. A locking bar on the hydrofoil serves to engage stops on the plate to lock same in retracted and deployed positions. A control permits remote operation of the locking bar.

10 Claims, 1 Drawing Sheet

HYDROFOIL WITH RETRACTABLE PLATE

BACKGROUND OF THE INVENTION

The present invention pertains generally to hydrofoils imparting lift to a watercraft.

In the prior art are hydrofoils carried by small watercraft with the primary objective being the reduction of the wetted surface area of a hull to reduce drag. As disclosed in U.S. Pat. No. 4,487,152, a hydrofoil may be mounted on a cavitation plate of an outboard motor or outdrive, in a modified version, for the purpose of lifting and stabilizing a boat hull. U.S. Pat. No. 3,114,343 discloses a hydrofoil system for use on recreational boats with pairs of fore and aft hydrofoils. U.S. Pat. No. 3,211,119 directs exhaust gases through a hydrofoil outlet.

On small fishing boats, it is common to utilize a plate called a trolling plate located rearwardly adjacent the propeller of an outboard motor to slow the craft to a desired trolling speed. Trolling plates are often carried by a bracket mounted on the motor cavitation plate and are retractable through ninety degrees to an inoperable or streamlined position. When deployed, a trolling plate reduces propeller efficiency to diminish boat speed.

SUMMARY OF THE PRESENT INVENTION

The present invention is embodied in a hydrofoil for a watercraft to impart lift to the craft hull with the hydrofoil additionally serving to slow the craft when so desired.

The present hydrofoil includes a positionable plate member which, upon deployment, decreases propeller deficiency in the general manner of a trolling plate. For watercraft operations at speeds above trolling speed the positionable member is retracted whereafter the hydrofoil serves as a source of lift for the hull. A lock mechanism maintains the plate member in the desired position with a control permitting remote positioning of the plate member. The hydrofoil has a recessed wall surface to permit the plate member to be retracted into a streamlined position.

Objectives of the present hydrofoil include the provision of a single unit for watercraft for imparting lift to the craft and hence a speed increase by a reduction wetted hull area with the additional capability of slowing the craft by deploying a plate member of the hydrofoil; the provision of a dual purpose hydrofoil which may be conveniently attached to the lower unit of an outboard engine or to the outdrive of an inboard-outboard propulsion unit.

BRIEF DESCRIPTION OF THE PREFERRED EMBODIMENTS

Figures 1, 2, 3, 4:
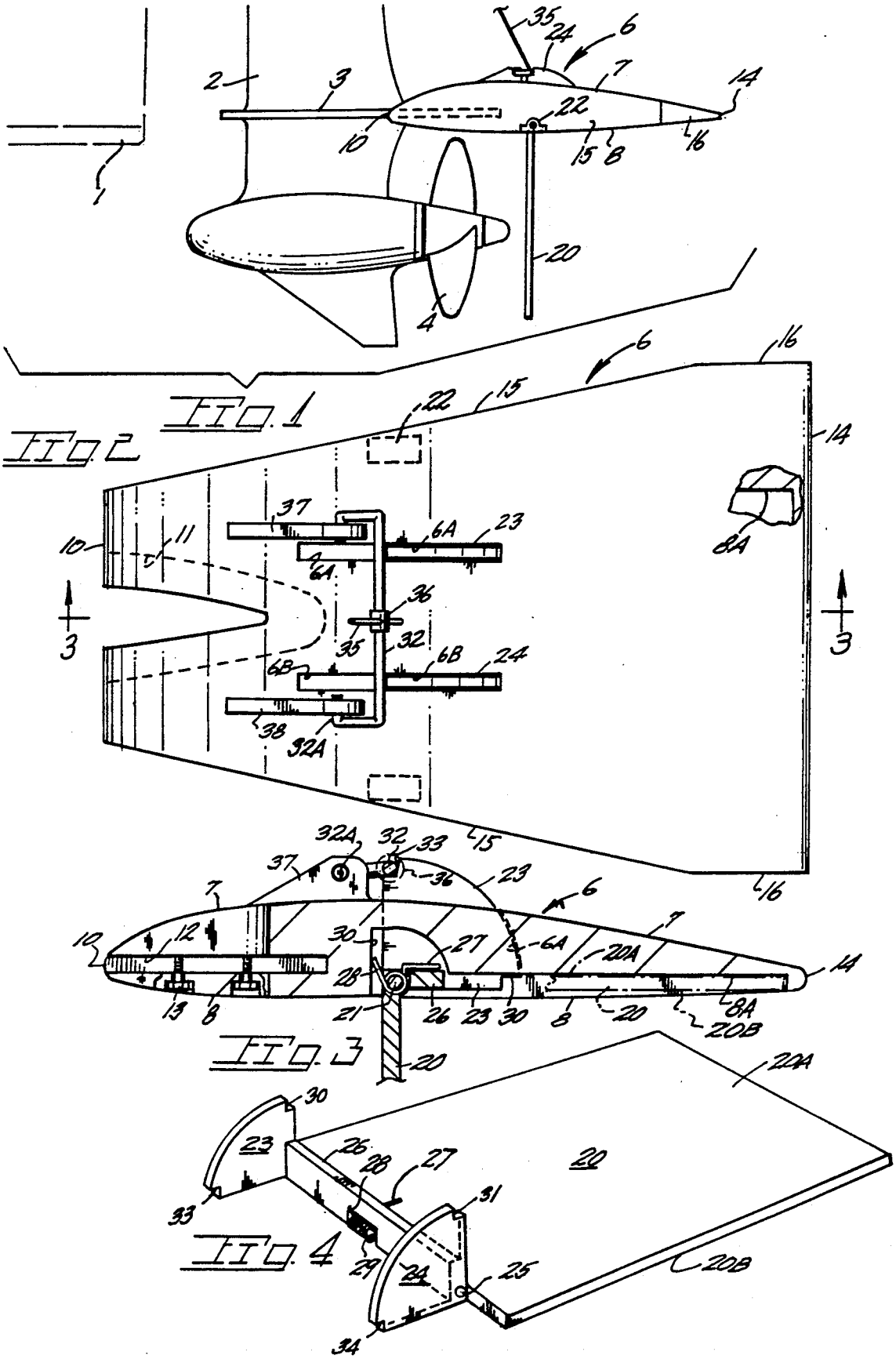
FIG. 1 is a side elevational view of the present hydrofoil located rearwardly of a boat transom.
FIG. 2 is a top plan view of the hydrofoil removed from a boat propulsion unit.
FIG. 3 is a vertical sectional view taken along line 3—3 of FIG. 2.
FIG. 4 is a perspective view of a positionable plate member of the hydrofoil.

With continuing attention to the drawings wherein applied reference numerals indicate parts similarly hereinafter identified, the reference numeral 1 indicates a portion of a boat hull below the waterline.

Adjacent the hull is a propulsion unit 2 shown in fragmentary form and may be the lower unit of an outboard motor or the outdrive of an inboard-outboard. A cavitation plate at 3 serves to restrict the formation of a partial void aft of a propeller 4. The foregoing description is intended to be only general in nature as a wide range of propulsion unit configurations exist.

The present hydrofoil is indicated generally at 6 and is of a lengthwise section to induce lift with upper and lower surfaces 7 and 8 being of different shapes with surface 7 having a camber to provide a pressure difference thereon similar to an airfoil. The leading edge. 10 of the hydrofoil may be recessed at 11 to receive a rearward portion of the propulsion unit while a planar surface at 12 permits surfacial engagement of the hydrofoil with the cavitation plate of the unit for mounting purposes as by threaded fasteners 13 extending upwardly through the cavitation plate into engagement with the hydrofoil. The hydrofoil may be of generally delta shape in plan view with a trailing edge at 14 and rearwardly diverging edges at 15 and sides at 16.

Swingably mounted on the underside or lower surface 8 is a positionable plate structure 20 carried by a pivot shaft 21 journalled in inset bearings as at 22. The plate 20 may be termed a trolling plate. As best viewed in FIG. 4, a pair of stops 23 and 24 are provided which project from the plate for cooperation with later described locking means. Plate upper and lower surfaces (when retracted) are at 20A and 20B with the plate upper surface being received within a recessed area 8A in the hydrofoil lower surface which terminates rearwardly proximate trailing edge 14 of the hydrofoil. Plate surface 20B serves as a hydrofoil lower surface when the plate is retracted. Located adjacent the leading edges of plate 20 is a bore 25 disposed transversely across the plate to receive pivot shaft 21 journalled in bearings 22. A flange 26 on the plate defines an open area 29 through which shaft 21 passes to receive a spiral spring having spring arms 27–28 which bias plate 20 toward an operative, extended position. Spring arm 27 bears against plate flange 26 while spring arm 28 bears against an internal wall surface 30 of the hydrofoil. For retention of plate 20 in place, the stops at 23 and 24 are shouldered at 30 and 31 for abutment with locking means 32 while an additional pair of shoulders at 33 and 34 on the stops cooperates with the locking means to prevent upward retraction of the plate in response to water impingement. Hydrofoil 6 is slotted at 6A and 6B to receive stops 23–24 to permit same to swing through 90 degrees or so during plate travel between deployed and retracted positions.

A control for the locking means may be embodied in a control wire 35 attached by a fitting 36 to locking means 32 to enable remote actuation of the locking means, for example, by a boat operator seated at an operator's station. Locking means 32 may be a member formed from rod stock having reversed end segments 32A pivotally carried within pedestals 37–38 on upper surface 7 of the hydrofoil. For the prevention of damage to plate 20 and locking means 32 by water exerted forces above trolling speeds, the shoulders 33 and 34 may be formed with surfaces inclined somewhat rearwardly and upwardly to the vertical to provide a camming action for upward displacement of the locking means permitting plate 20 to retract automatically from heavy propeller wash with the locking means subsequently engaging shoulders 30–31 for plate retention.

In use, the plate 20 is deployed by spring action upon actuation of remote control 35. The lowered plate inhibits water flow past propeller 4 to reduce the speed of the watercraft. At the cessation of slow speed operation of the watercraft, actuation of control 35 permits plate 20 to retract out of the propeller wash to the streamlined or stowed position on the underside of the hydrofoil with latching of same in place by locking means 32.

A range of hydrofoil shapes and sizes may be utilized to achieve desired hull lift and attitude.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

I claim:

1. An attachment for securement to the lower housing of an outboard motor or outdrive unit of a boat proximate the propeller of same, said attachment comprising, a hydrofoil having a leading edge and a trailing edge and a curved upper surface providing a camber, said leading edge defining a rearwardly extending recess to receive a portion of said housing, a plate pivotally mounted on the hydrofoil and having a retracted position and a deployed position rearwardly of the propeller for affecting propeller efficiency and boat speed, and locking means acting on said plate to maintain same in an upright deployed position against displacement by water impingement.

2. In combination:

a lower housing of a boat propulsion unit including a propeller, a hydrofoil having a leading edge defining a rearwardly extending recess to receive said propulsion unit, said hydrofoil having a curved upper surface providing a camber, a trolling plate swingably mounted on the underside of said hydrofoil and having retracted and upright deployed positions, and locking means on said hydrofoil engageable with the trolling plate to maintain same in the upright deployed position proximate said propeller to reduce propeller efficiency.

3. The combination claimed in claim 2 additionally including remotely actuated control means coupled to said locking means to enable unlocking of the trolling plate from the operator station of the boat, said locking means including pedestals on said hydrofoil and a member pivotally carried by said pedestals and engageable with said plate.

4. The combination claimed in claim 3 wherein said trolling plate includes upright stops having shoulders engageable with said member in both the retracted and deployed positions of the trolling plate.

5. The combination claimed in claim 2 wherein said hydrofoil defines a recessed area on tis underside to receive said trolling plate in the retracted position, said recessed area terminating proximate the trailing edge of the hydrofoil.

6. In a hydrofoil for a boat propulsion unit having a propeller, the improvement comprising, a plate member having a first position inset within a hydrofoil surface and a second position substantially normal to said hydrofoil surface and rearwardly of the propulsion unit propeller, pivot means attaching said plate member to the hydrofoil, means biasing said plate member to said second position, locking means engageable with the plate member to retain same in said first and second positions respectively in place against water impingement and when retracted into said hydrofoil, control means coupled to said locking means and surfaces of the hydrofoil extending rearwardly from a leading edge of the hydrofoil to define an area for the reception of the propulsion unit.

7. The improvement claimed in claim 6 wherein said plate member includes a surface which functions as a hydrofoil surface when said plate member is in said first position.

8. The improvement claimed in claim 6 wherein said plate member includes at lest one stop having spaced apart shoulders thereon cooperable with said locking means.

9. The improvement claimed in claim 8 wherein said locking means includes a member pivotally mounted on said hydrofoil, said shoulders disposed so as to act as a camming surface to displace said member for plate member release in the presence of excessive water pressure on the plate member.

10. In a hydrofoil, the improvement comprising, a plate member having a first position substantially in parallel with a hydrofoil surface and a second position substantially normal to said hydrofoil surface, said plate member including at least one stop having a shoulder thereon, pivot means attaching said plate member to the hydrofoil, locking means engageable with the plate member to retain same in said second position in place against water impingement, said locking means further including a rod member, said shoulder disposed so as to act as a camming surface to displace said rod member for plate member release in the presence of excessive water pressure on the plate member, and control means coupled to said locking means.

* * * * *